US008033330B2

(12) United States Patent
Hall et al.

(10) Patent No.: US 8,033,330 B2
(45) Date of Patent: Oct. 11, 2011

(54) TOOL STRING THREADS

(75) Inventors: David R. Hall, Provo, UT (US); Scott Dahlgren, Alpine, UT (US); Jonathan Marshall, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 91 days.

(21) Appl. No.: 11/947,949

(22) Filed: Nov. 30, 2007

(65) Prior Publication Data

US 2009/0139711 A1 Jun. 4, 2009

(51) Int. Cl.
*E21B 17/042* (2006.01)

(52) U.S. Cl. ..... 166/242.6; 285/333

(58) Field of Classification Search ..... 285/333, 285/334; 175/40–42, 44–46, 48, 50
See application file for complete search history.

(56) References Cited

U.S. PATENT DOCUMENTS 1,731,171 A * 10/1929 Perkins ..... 285/123.1
2,204,754 A * 6/1940 Frame ..... 285/334
2,267,923 A * 12/1941 Johnson ..... 285/334
2,307,688 A * 1/1943 Larson ..... 166/176
2,772,102 A * 11/1956 Webb ..... 285/334
3,572,777 A * 3/1971 Blose et al. ..... 285/334
3,626,733 A 12/1971 Zook
3,651,678 A 3/1972 Zook
3,754,609 A * 8/1973 Garrett ..... 175/323
4,071,067 A * 1/1978 Goldby ..... 411/307
4,076,064 A * 2/1978 Holmes ..... 411/285
4,150,702 A * 4/1979 Holmes ..... 411/310
4,629,223 A * 12/1986 Dearden et al. ..... 285/334
4,826,377 A * 5/1989 Holmes ..... 411/311
4,958,973 A * 9/1990 Sugimura ..... 411/423
5,286,069 A * 2/1994 Wilson ..... 285/114
5,358,289 A * 10/1994 Banker et al. ..... 285/334
5,492,375 A 2/1996 Smith
5,515,708 A 5/1996 D'Agostino
5,865,581 A 2/1999 Sadri
6,247,542 B1 * 6/2001 Kruspe et al. ..... 175/40
(Continued)

OTHER PUBLICATIONS

Merriam-Webster's defintion of "Comprise", accessed Feb. 18, 2010.*

*Primary Examiner* — William P Neuder
*Assistant Examiner* — Blake Michener
(74) *Attorney, Agent, or Firm* — Brink Hofer Gilson & Lione

(57) ABSTRACT

A downhole tool string component that includes a tubular body with an inner surface, an outer surface and a shoulder extending from the outer surface at one end of the tubular body, a sleeve disposed about the outer surface having an end face in contact with the shoulder. The downhole tool string component further includes a loading member disposed about the outer surface near the other end of the tubular body and which is adapted for loading the sleeve against the shoulder. The loading member includes an internal threadform that is adapted to threadingly engage an external threadform formed into the outer surface of the tubular body. At least one of the external threadform and the internal threadform includes a plurality of threads with a distal thread having a first thread height and a proximal thread has a second thread height, with the first thread height being greater than the second thread height and a plurality of the threads heights between the first and second thread heights continuously tapering from the first height to the second height.

20 Claims, 7 Drawing Sheets

U.S. PATENT DOCUMENTS

| | | | | |
|---|---|---|---|---|
| 6,447,025 | B1 | 9/2002 | Smith | |
| 6,659,878 | B2 * | 12/2003 | Anderson | 470/18 |
| 2002/0166699 | A1 * | 11/2002 | Evans | 175/26 |
| 2003/0038476 | A1 * | 2/2003 | Galle et al. | 285/92 |
| 2004/0178626 | A1 * | 9/2004 | Segreto | 285/47 |
| 2004/0256153 | A1 * | 12/2004 | Helms et al. | 175/45 |
| 2006/0089976 | A1 * | 4/2006 | Breihan et al. | 709/218 |
| 2006/0214421 | A1 * | 9/2006 | Muradov | 285/333 |
| 2007/0227775 | A1 * | 10/2007 | Ma et al. | 175/26 |
| 2010/0123311 | A1 * | 5/2010 | Church | 285/334 |

* cited by examiner

TOOL STRING THREADS

BACKGROUND OF THE INVENTION

The current application relates to downhole drilling. During downhole drilling torque acts on downhole drilling tools which if directed towards drilling instrumentation can lead to their failure. These devices may be very expensive to replace and if damaged could lead to drilling delays and other possible failures.

U.S. Pat. No. 6,447,025 to Smith, which is herein incorporated by reference for all that it contains discloses an oilfield tubular member that includes a pin member and a box member, each have a tapered thread. The pin thread has a root, a crest, a pressure flank, and a stab flank. The box thread has a root, a crest, a pressure flank, and a stab flank. The pin crest has a stab flank pin crest radius and a pressure flank pin crust radius which is at least twice the radius. The improved oilfield connection minimizes damage to the connection during misalignment of the pin member and box member.

U.S. Pat. No. 5,492,375 to Smith, which is herein incorporated by reference for all that it contains discloses a tubular drill pipe having a pin connector at one end and a box connector at the other end has each connector adapted to mate with a connector similar to that at the opposite end of the pipe—but on another pipe, to form a tool joint. The connectors are of the type having two pair of axially abutting make-up faces; a primary annular shoulder formed at the inner end of the base of the pin connector, and an internal secondary shoulder at the inner extremity of the base of the box connector which abuts the end of an outermost nose section of the pin connector.

U.S. Pat. No. 3,651,678 to Zook et al., which is incorporated by reference for all that it contains discloses a through feed thread rolling die for rolling external threads on a cylindrical work piece has an external thread thereon with relieved starting and finishing sections, the starting relief providing flat crests which form a predetermined angle with the roll axis and taper to a diameter at the starting end less than the mean height of the fully formed threads. A modified version tapers the starting section at the larger angle than the predetermined angle of the crests thereby reducing the length of the starting section. The invention includes the method of metal movement caused by the die in the formation of the thread.

BRIEF SUMMARY OF THE INVENTION

In one aspect of the invention, a downhole tool string component comprising a tubular body with a first and second end. The tubular body of the tool string comprises an inner surface and an outer surface. At least one sleeve is mounted about the outer surface of the tubular body. The tubular body comprises a shoulder near either the first or second end and is in mechanical communication with the at least one sleeve. A loading member near the other end of the tubular component is disposed about the outer surface and is adapted for loading the at least one sleeve against the shoulder. The loading member comprises an internal threadform adapted to threadingly engage an external threadform in the outer surface of the tubular body. Either the external threadform or the internal threadform comprises a plurality of threads with a distal thread comprising a first thread height and a proximal thread comprising a second thread height. Wherein the first thread height is greater than the second thread height and a plurality of the threads heights between the first and second thread heights accumulatively taper from the first height to the second height.

The shoulder of the tubular body may be formed on the outer surface. The shoulder may be an attachment to the outer surface. The shoulder may also be threadedly attached to the outer surface of the tubular body.

The thread heights may be formed in part from machining. The thread heights may be truncated. The threads of the internal threadform may comprise substantially equal heights. The threads of the external threadform may also comprise substantially equal heights. The external threadform may be between 5 and 9 inches long. The external threadform may also comprise tapered threads. The internal and external threadforms may be straight threads. One threadform from the internal threadform or the external threadform may be truncated while the other may be nontruncated. A pocket may be provided between the at least one sleeve and the outer surface of the tubular body. The downhole instrumentation may be secured within the pocket. The accumulative taper may be between 0.1-5 degrees from the loading member to the shoulder. The sleeve may be rotationally fixed to the tubular body. A stress relief groove may be disposed in the outer surface adjacent and proximal to the external threadform.

DETAILED DESCRIPTION OF THE INVENTION AND THE PREFERRED EMBODIMENT

Figure 1:
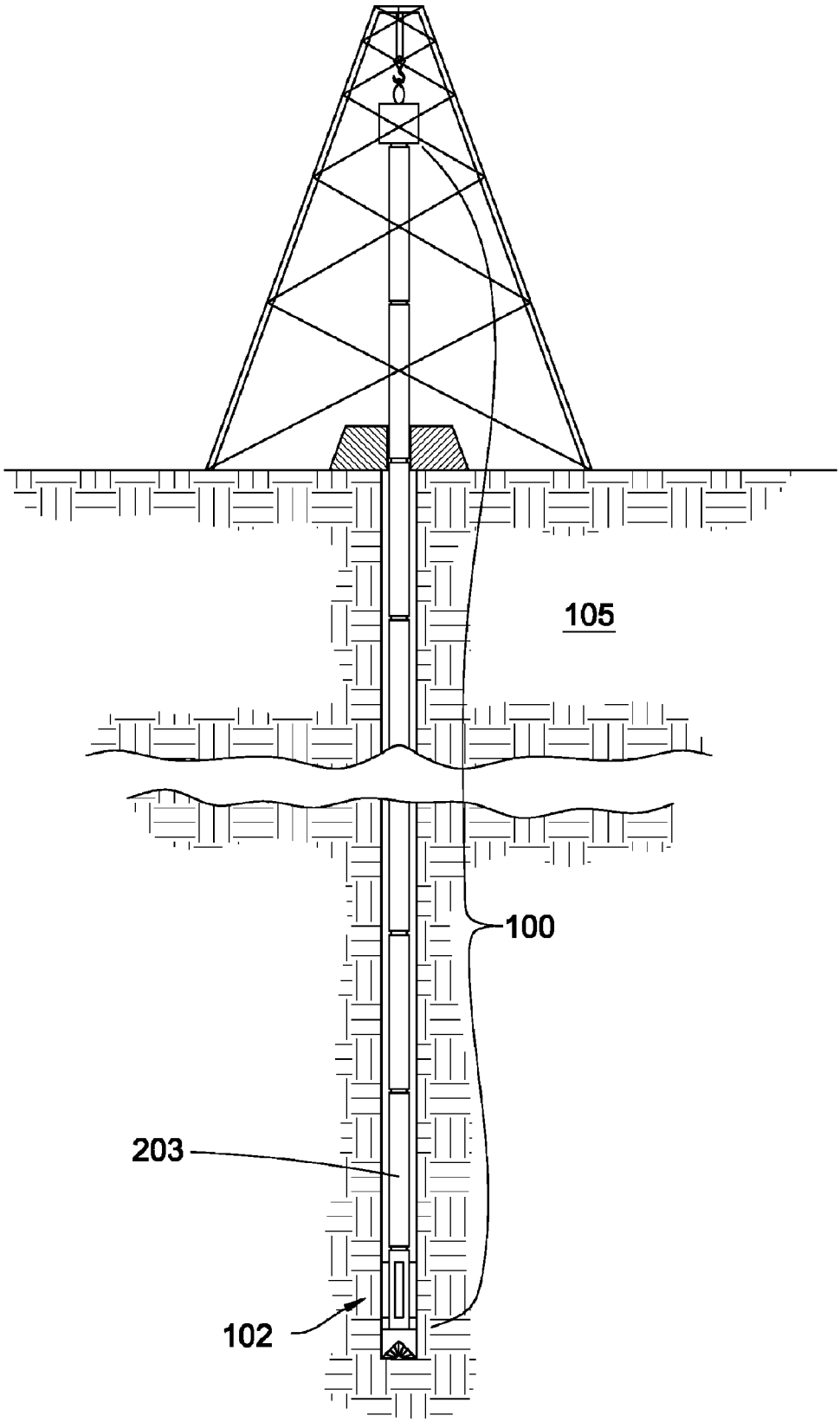
FIG. 1 is an orthogonal diagram of an embodiment of a tool string.

FIG. 1 is an orthogonal diagram of an embodiment of a tool string 100 comprising a drill bit 102 located at the bottom of a bore hole. The tool string 100 may be made of rigid drill pipe, drill collars, heavy weight pipe, jars, and/or subs. The tool string 100 may also comprise a sleeve 203 that may be adapted to protect downhole instrumentation. As the drill bit 102 rotates downhole the tool string 100 advances farther into the formation 105 due to the weight on the drill bit 102 and a cutting action of the drill bit 102.

Figure 2:
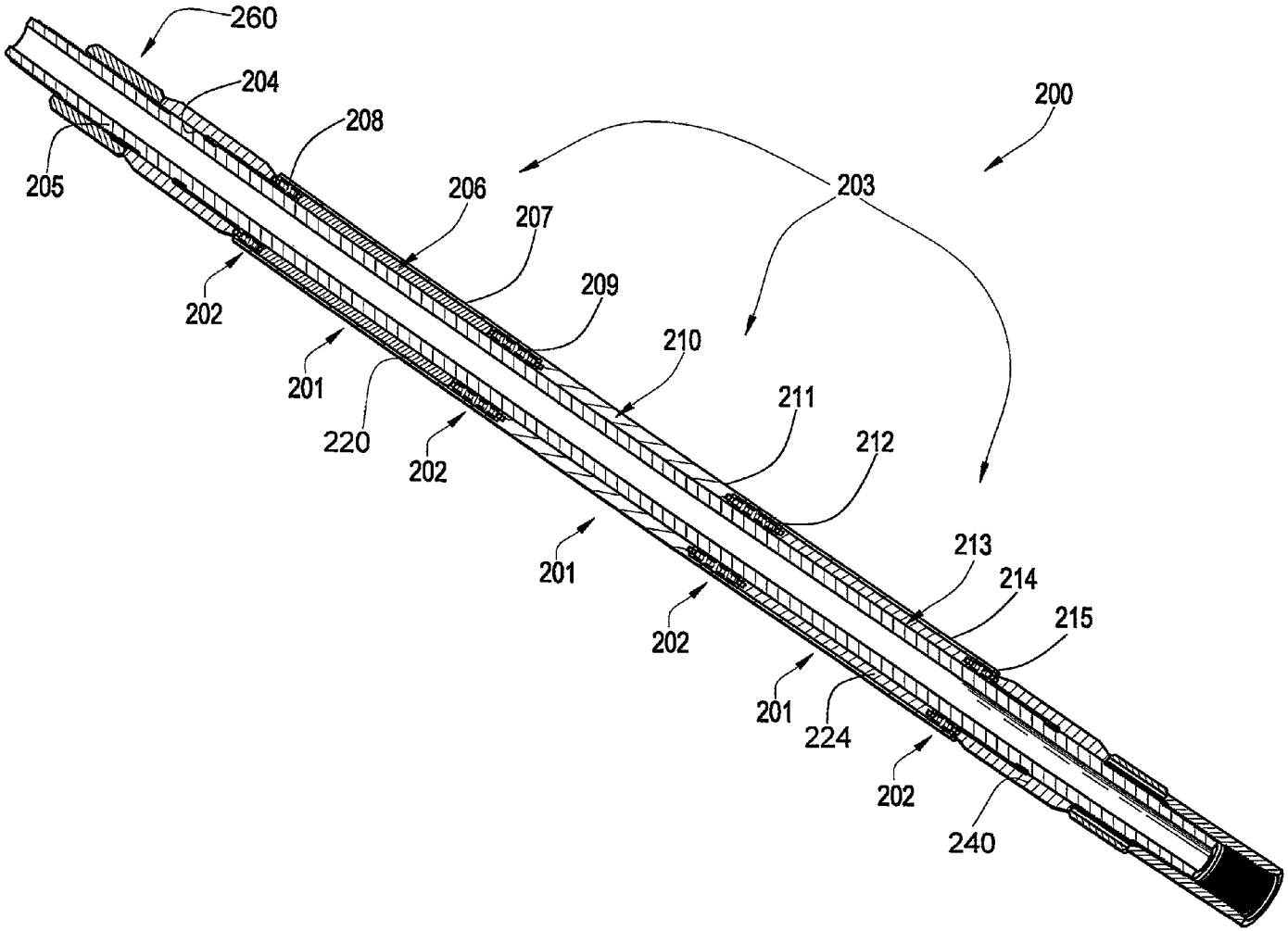
FIG. 2 is a cross-sectional diagram of an embodiment of a tool string component.

A downhole tool string component 200 in the tool string 100 may comprise a plurality of pockets 201, as in the embodiment of FIG. 2. The pockets 201 may be formed by a plurality of flanges 202 disposed around the component 200 at different axial locations and covered by individual sleeves disposed between and around the flanges 202. A first pocket 206 may be formed around an outer diameter 204 of a tubular body 205 by a first sleeve 207 disposed around the tubular body 205 such that opposite ends of the first sleeve 207 fit around at least a portion of a first flange 208 and a second flange 209. A second pocket 210 may be formed around the outer diameter 204 of the tubular body 205 by a second sleeve 211 disposed around the tubular body 205 such that opposite ends of the second sleeve 211 fit around at least a portion of the second flange 209 and a third flange 212. A third pocket 213 may also be formed around the outer diameter 204 of the tubular body 205 by a third sleeve 214 disposed around the tubular body 205 such that opposite ends of the third sleeve 214 fit around at least a portion of the third flange 212 and a fourth flange 215. The sleeves may be interlocked or keyed together near the flanges 202 for extra torsional support.

The individual sleeves may allow for better axial and torsional flexibility of the component 200 than if the component 200 comprised a single sleeve 203 spanning the pockets 201. The sleeve may also comprise a plurality of grooves adapted to allow the sleeves to stretch and/or flex with the tubular body 205. At least one sleeve may be made of a non magnetic material, which may be useful in embodiments using magnetic sensors or other electronics. The pockets 201 may be sealed, though a sleeve and the pocket may comprise openings adapted to allow fluid to pass through the sleeve such that one of the pockets is a wet pocket.

Downhole instrumentation 220 may be disposed within at least one of the pockets of the tool string component 200. An instrumentation housing 224 may be disposed within at least one of the pockets wherein the downhole instrumentation may be disposed, which may protect the equipment from downhole conditions. The instrumentation may comprise sensors for monitoring downhole conditions. The sensors may include pressure sensors, strain sensors, flow sensors, acoustic sensors, temperature sensors, torque sensors, position sensors, vibration sensors, geophones, hydrophones, electrical potential sensors, nuclear sensors, or any combination thereof. Information gathered from the sensors may be used either by an operator at the surface or by the closed-loop system downhole for modifications during the drilling process. If the downhole instrumentation is disposed in more than one pocket, the pockets may be in electrical communication, which may be through an electrically conductive conduit disposed within the flange separating them.

The tubular body 205 can further include a shoulder 240 extending from one end of the tubular body that is adapted to contact an end face of one of the sleeves 203. In one aspect the shoulder may be formed on the outer surface of the tubular body. In the aspect, as shown in FIG. 2, the shoulder 240 may be attached to the outer surface of the tubular body 205 with a threaded connection.

As described in more detail below, a loading member 260 can be disposed about or coupled to the outer surface at the other end of the tubular body 205, and can be adapted to contact an end face of one of the sleeves 203 opposite the end face which contacts the shoulder 240, for loading the one or more sleeves 203 disposed about the outer surface of the tubular body against the shoulder 240 and locking the sleeves into place. In one aspect the loading member 260 can include an internal threadform adapted to threadingly engage an external threadform formed into the outer surface of the tubular body.

Figure 3:
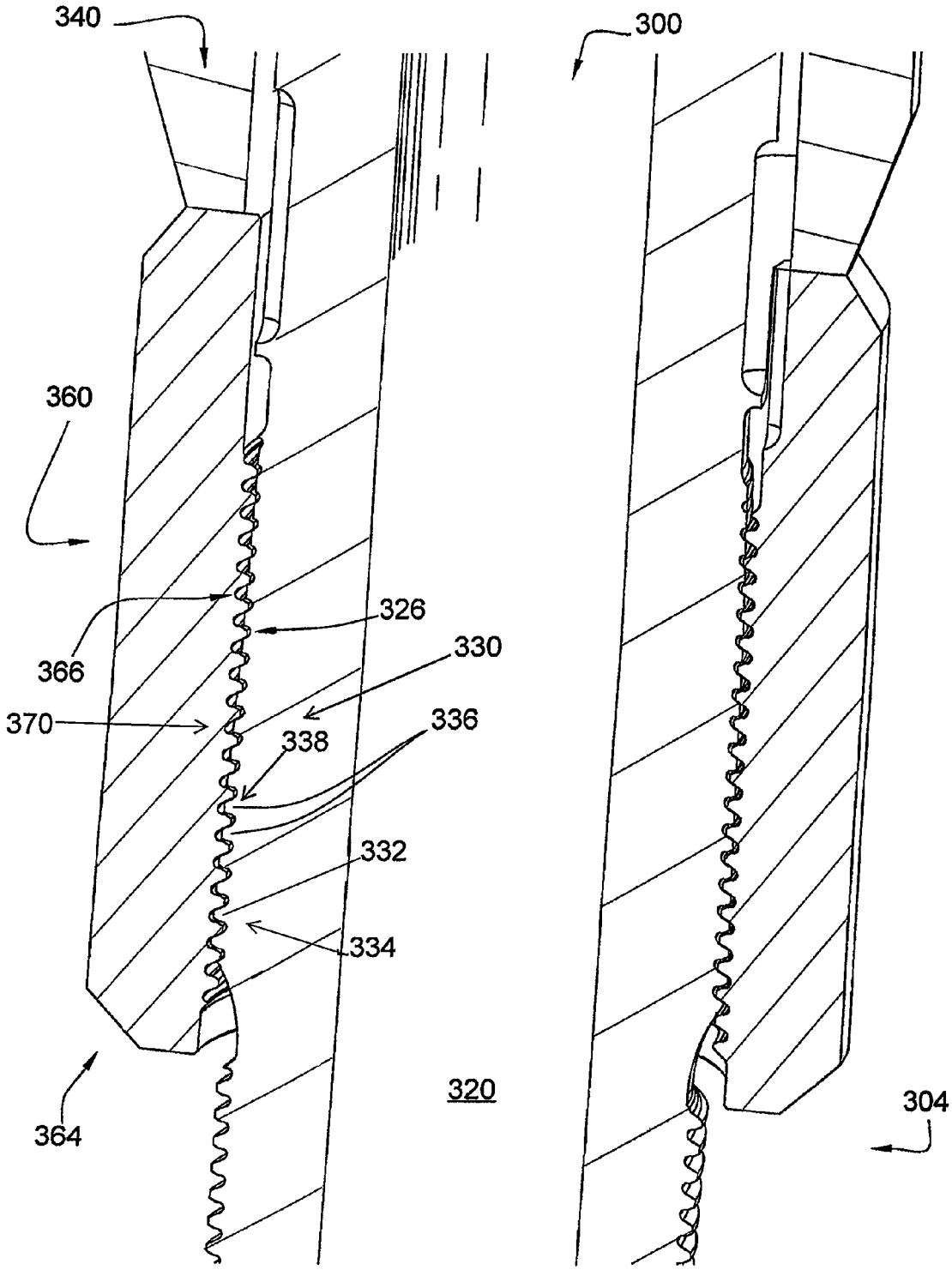
FIG. 3 is another cross-sectional diagram of an embodiment of a tool string component.

Now referring to FIG. 3, in another representative embodiment the loading member 360 may abut one of the sleeves 340 disposed around the tubular body 320 at a first or distal end 304 of the tool string component 300. The loading member 360 is adapted to form a primary shoulder 364 of the component for connection to an adjacent tool string component. The loading member may also lock the sleeve 340 in place. In some embodiments, the loading member is threaded in a different direction than either the sleeves or thread adapted for connection to the adjacent tool string component.

The loading member 360 may be threadedly attached to the external threadforms 330 of a tubular body 320. The internal threads 370 of the loading member 360 may comprise a plurality of threads 366 of substantially equal heights, while the external threadform 330 of the tubular body 320 may comprise a plurality of threads 326 inciuding a distal thread 332 proximate the distal end 304 of the tool string component 300 having a first thread height 334 that is greater than a second thread height 338 of one or more proximal threads 336 that are closer or proximate to the sleeve 340. The height differential from the distal thread 332 and proximal threads 336 may comprise a 0.1-5 degree taper. The internal threadform 370 and the external threadform 330 may comprise a substantially similar spacing between each of the individual threads 326, 366. Additionally, the individual threads 326 of the external threadform 330 of the tubular body 320 may be truncated.

Figure 4:
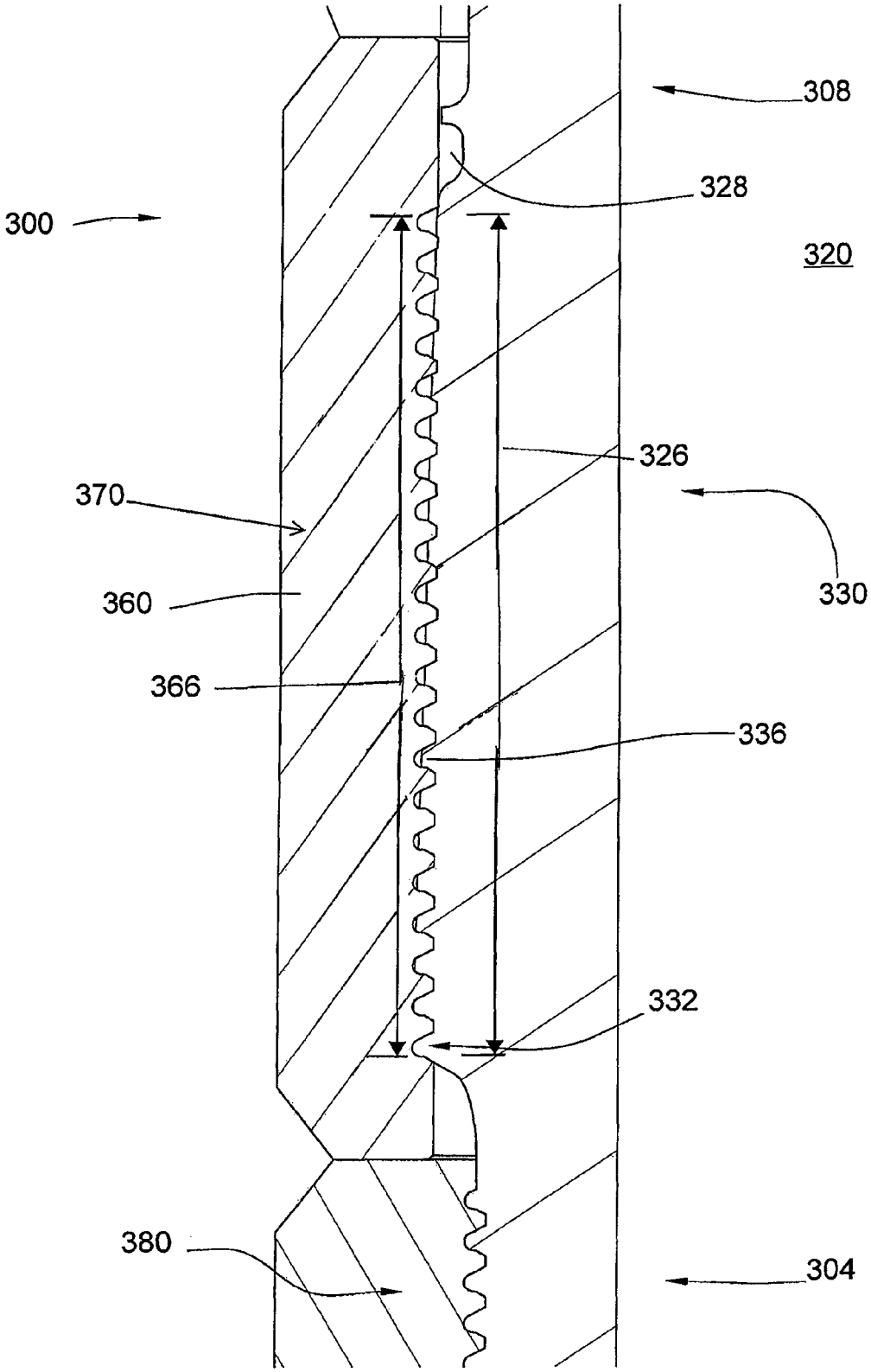
FIG. 4 is another cross-sectional diagram of an embodiment of a tool string component.

Additional details of the representative embodiment 300 of the tool string component are provided with the cross-sectional diagram of FIG. 4. As discussed above, the external threadform 330 on the tubular body 320 may comprise individual threads 326 with the first or distal thread 332 comprising a greater height than one or more second or proximal threads 336, while the internal threadform 370 of the loading member 360 may comprise a plurality of threads 366 with a substantially consistent height. When the threadforms 330, 370 are engaged the engagement surface diminishes from the distal thread to the proximal thread. The height differential may comprise a 0.1-5 degree taper. This may allow for more compliancy between the attachment of the loading member 360 and the tubular body 320 and may prevent breakage. The external threadforms 330 and internal threadform 370 may extend over half the length of the loading member 360.

Large amounts of torque may be applied to the tool string component 300 in downhole conditions. The thread geometry, as shown in FIG. 4, may aid in protecting the tool string component 300 and instrumentation in the tool string component from torsion forces. These instrumentations may be very expensive to replace and if damaged could lead to drilling delays and other possible failures. Torsion forces may travel from the proximal end 308 through the distal end 304 of the tool string component 300 along the taper of the tubular body 320. The external threadform 330 may further comprise a relief groove 328 that may decrease the occurrence of stress risers in the tool string. In yet another aspect, the loading member 360 may be locked into place by a tool joint 380 of an adjacent tool string component.

Figure 5:
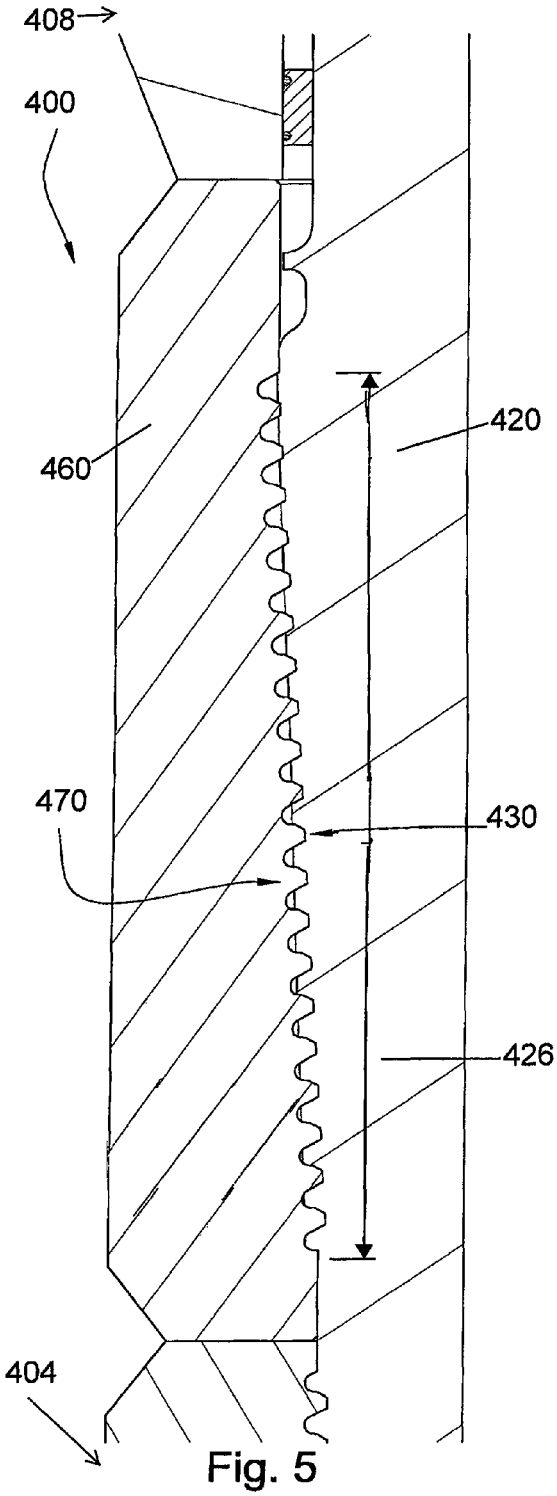
FIG. 5 is another cross-sectional diagram of an embodiment of a tool string component.

FIG. 5 is cross-sectional diagram of another representative embodiment 400 of the tool string component. The internal threadforms 470 and the external threadforms 430 may extend two-thirds the length of the loading member 460. Both the internal threadform 470 of the loading member 460 and the external threadform 430 of the tubular body 420 may be tapered outwardly from the distal end 404 to the proximal end 408 of the tool string component 400, while the thread heights of the individual threads 426 of the external threadform 430 may comprise a 0.1-5 degree taper and may be truncated.

Figure 6:
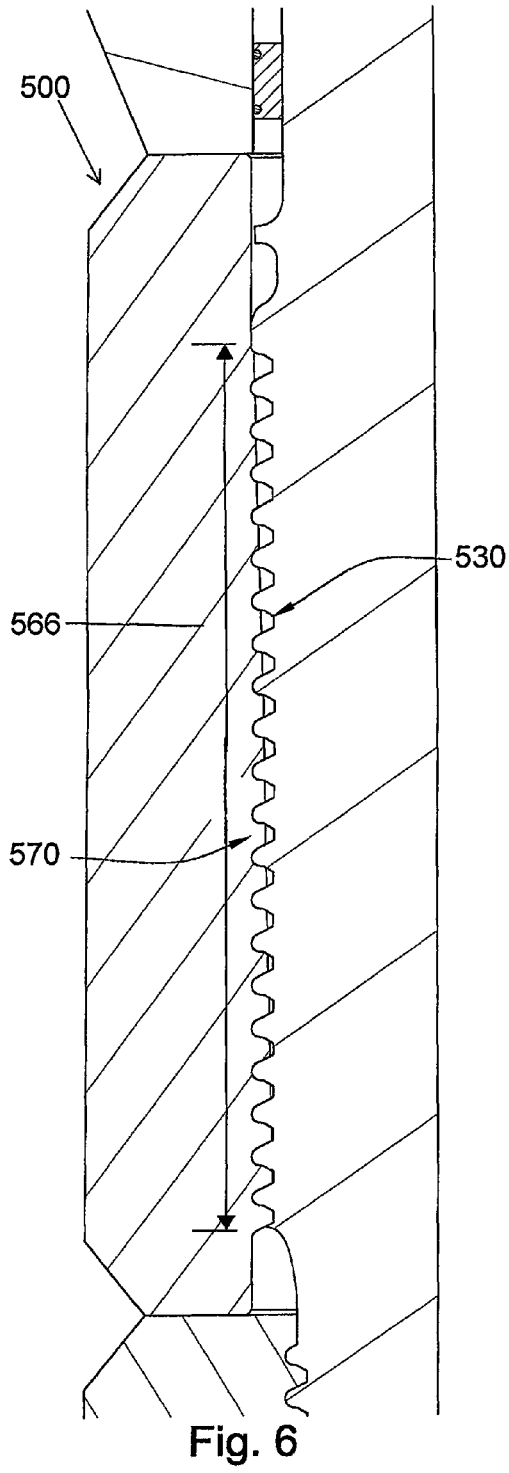
FIG. 6 is another cross-sectional diagram of an embodiment of a tool string component.

In yet another aspect of the tool string component 500, both the internal threadform 570 and the external threadform 530 may be linear, while the thread heights of the individual threads 566 of the internal threadform 570 may comprise a 0.1-5 degree taper and may be truncated, such as shown in FIG. 6.

Figure 7:
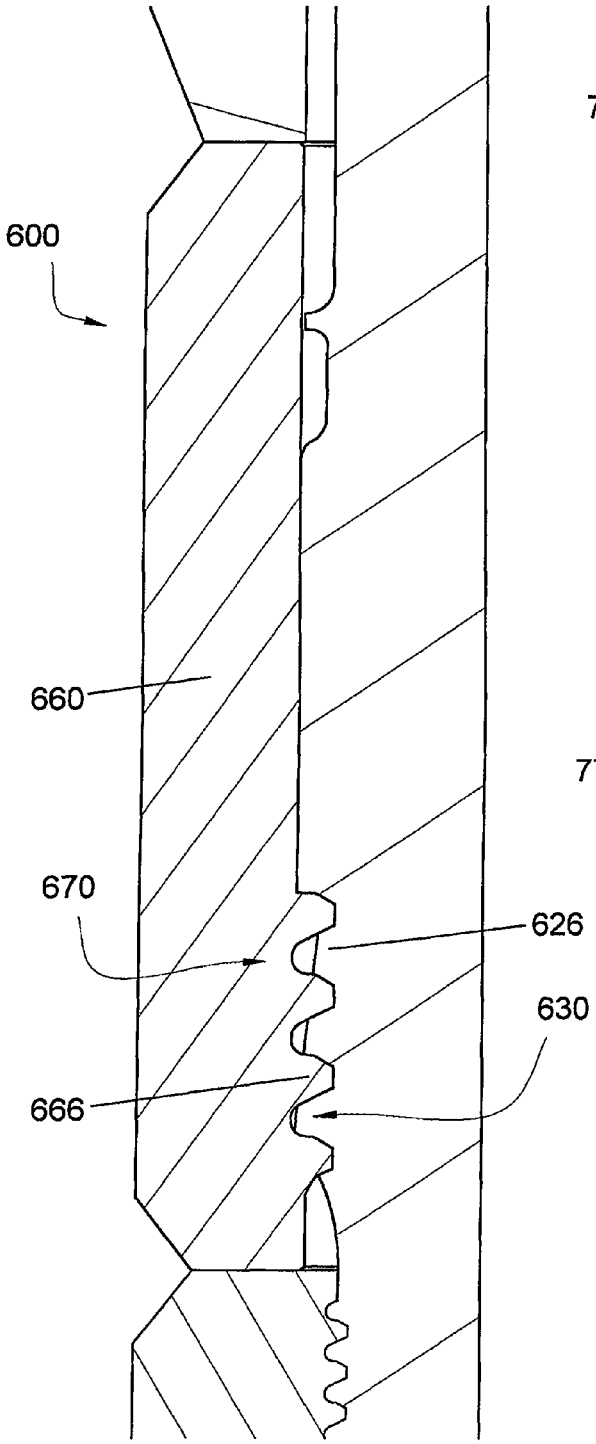
FIG. 7 is another cross-sectional diagram of an embodiment of a tool string component.

Referring now to FIG. 7. in another representative embodiment 600 of the tool string component the internal threadform 630 and external threadform 670 may be less than half the length of the loading member 660. The external threadform 630 may also comprise a truncated geometry, and the internal threadform 670 may comprise a non-truncated geometry. The individual threads 626, 666 of the threadforms 630, 670 may be spaced 0.5-0.3 inches.

Figure 8:
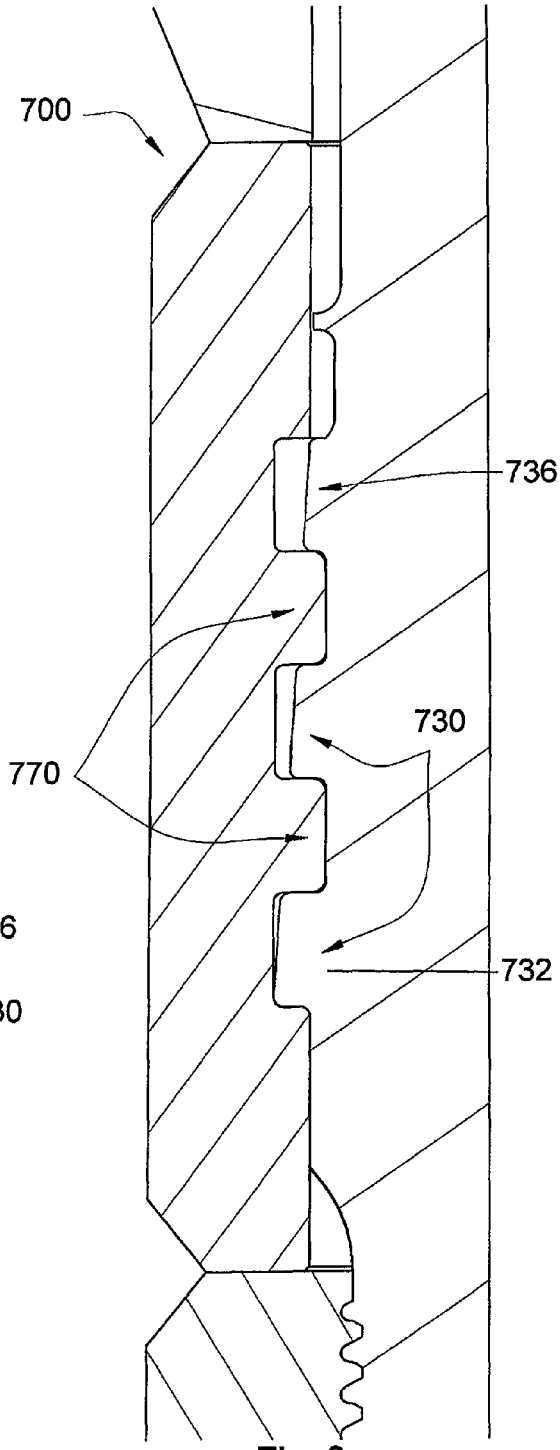
FIG. 8 is another cross-sectional diagram of an embodiment of a tool string component.

FIG. 8 is a cross-sectional diagram of another representative embodiment 700 of the tool string component. The external threadform 730 may comprise a castle or course thread that engages a complimentary internal threadform 770. As discussed above, the external threadform 730 may comprise a first distal thread 732 with a height larger than the second proximal thread 736 which may comprise a taper. This geometry may spread load forces that may occur during downhole drilling and prevent premature breakage and stress fractures.

Figure 9:
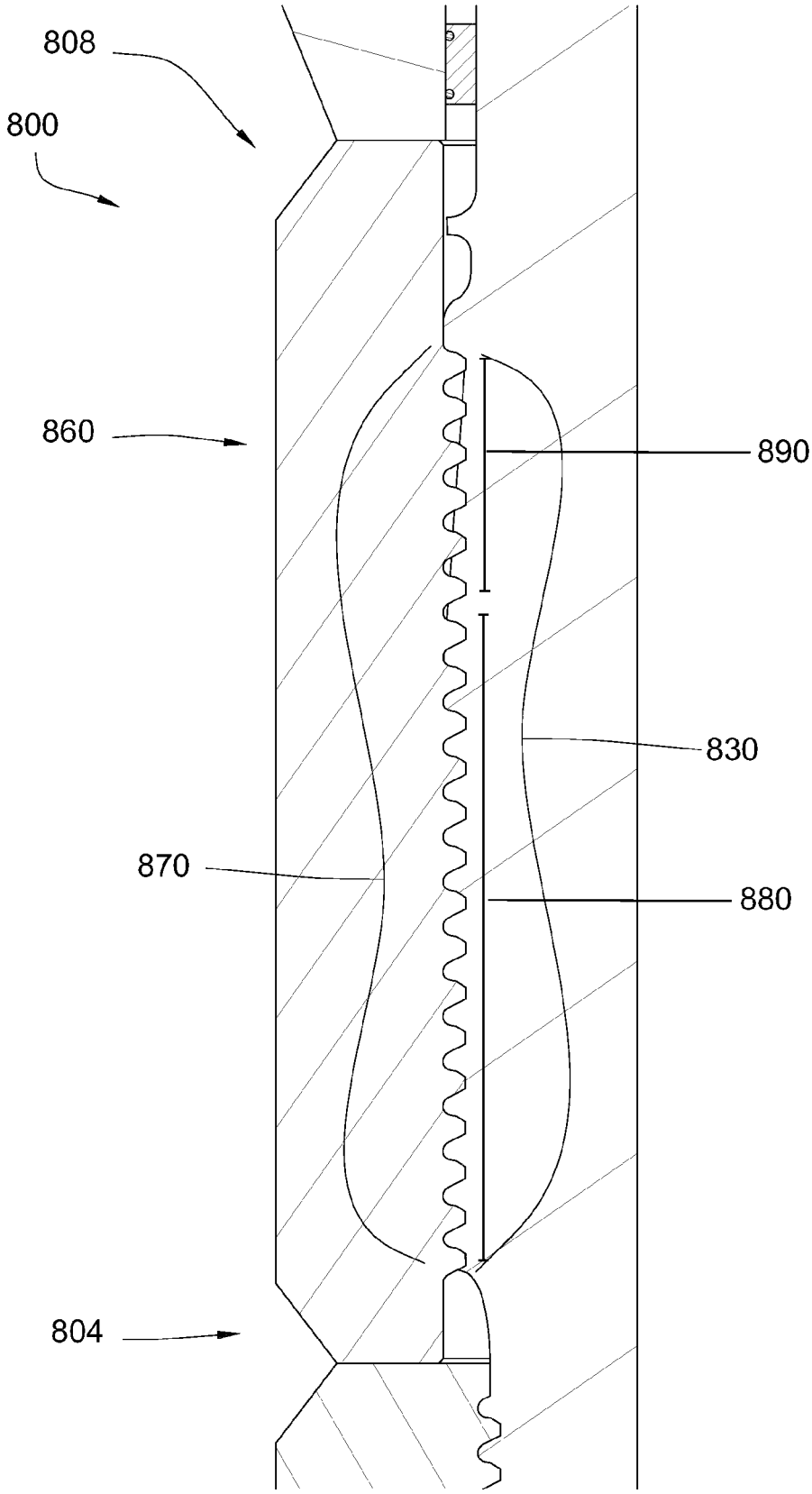
FIG. 9 is another cross-sectional diagram of an embodiment of a tool string component.

FIG. 9 is a cross-sectional diagram of yet another representative 800 embodiment of the tool string component including internal threadforms 870 and external threadforms 830. The geometry of the external threadform 830 may comprise a linear geometry 880, wherein each thread has the same height, from the distal end 804 of the loading member 860 and a tapered geometry 890 extending to the proximal end 808 of the loading member 860. The taper may be 0.1-5 degrees from the middle of the threadform to the shoulder. The internal threadform 870 may comprise a linear geometry from the distal end 804 to the proximal end 808, not illustrated.

Whereas the present invention has been described in particular relation to the drawings attached hereto, it should be understood that other and further modifications apart from those shown or suggested herein, may be made within the scope and spirit of the present invention.

What is claimed is:

1. A downhole tool string component, comprising:

a tubular body including an inner surface, and an outer surface;

an external threadform disposed on said outer surface, said threadform having a first plurality of threads;

at least one sleeve having a first end face and a second end face, said second end face spaced apart from said first end face, said sleeve disposed about said outer surface;

a shoulder extending from said tubular body and adapted to contact said first end face; and a loading member disposed about said outer surface, said loading member having a first end adapted to contact said second end face of said sleeve, a second end adapted to form a component shoulder for connection to an adjacent tool string component, and an internal threadform having a second plurality of threads adapted to engage said first plurality of threads;

wherein at least one of said first plurality of threads and said second plurality of threads includes a distal thread proximate said second end having a first thread height and a proximal thread proximate said sleeve having a second thread height, said first thread height being greater than said second thread height.

2. The component of claim 1, wherein said shoulder is formed on said outer surface.

3. The component of claim 1, wherein said shoulder is attached to said outer surface.

4. The component of claim 3, wherein said shoulder is threadedly attached to said outer surface.

5. The component of claim 1, wherein said proximal thread is truncated.

6. The component of claim 1, wherein each thread of said second plurality of threads are of substantially equal heights.

7. The component of claim 1, wherein each thread of said first plurality of threads are of substantially equal heights.

8. The component of claim 1, further having a radial pocket located between said sleeve and said outer surface of said tubular body.

9. The component of claim 8, further comprising downhole instrumentation secured within said radial pocket.

10. The component of claim 1, wherein each thread of said at least one of said first plurality of threads and said second plurality of threads has a thread height and wherein said thread height continuously tapers from said first height to said second height, said continuous taper being between 0.1 degrees and 5 degrees.

11. The component of claim 1, wherein said external threadform is between 5 and 9 inches long.

12. The component of claim 1, wherein said first plurality of threads and said second plurality of threads have a thickness ranging from 0.1 inch to 0.25 inch thick.

13. The component of claim 1, wherein said first plurality of threads are tapered.

14. The component of claim 1, wherein said first plurality of threads and said second plurality of threads are straight threads.

15. The connection of claim 1, wherein one of said internal threadform and said external threadform is truncated while said opposing threadform is non-truncated.

16. The connection of claim 1, wherein one of said internal threadform and said external threadform has a linear geometry near said distal thread and a tapered geometry near said proximal thread.

17. The component of claim 1, wherein said loading member is separate from a tool joint of an adjacent tool string component.

18. A downhole tool string component, comprising:

a tubular body including an inner surface, an outer surface, a shoulder portion formed on said outer surface, and an external threadform formed into said outer surface proximate an end of said tubular body;

at least one sleeve disposed about said outer surface and having a first end face in contact with said shoulder portion and a second end face spaced apart from said first end face; and a loading member adapted to contact said second end face, said loading member having a shoulder adapted to connect to an adjacent downhole component, and said loading member having an internal threadform adapted to threadably engage said external threadform;

wherein at least one of said external and internal threadforms comprises a plurality of threads having a plurality of thread heights, said plurality of threads including a distal thread proximate said end of said tubular body having a first thread height and a proximal thread spaced apart from said distal thread having a second thread height; and wherein said first thread height is greater than said second thread height and a plurality of said threads heights continuously decreases from said first thread height to said second thread height to provide a diminishing engagement surface from said distal thread to said proximal thread.

19. A downhole tool string component, comprising:

a tubular body including:

an inner surface and an outer surface;

a shoulder portion extending from said outer surface proximate a first end of said tubular body; and an external threadform formed into said outer surface proximate a second end of said tubular body;

at least one sleeve disposed about said outer surface and having a first end face in contact with said shoulder portion and a second end face spaced apart from said first end face;

a loading member disposed about said outer surface, said loading member in contact with said second end face of said sleeve and adapted for loading said sleeve against said shoulder portion, said loading member having a member shoulder for connection to an adjacent tool string, said member shoulder spaced apart from second end face, said loading member including an internal threadform engagable with said external threadform of said tubular body; and at least one of said internal and external threadforms having a plurality of engagable threads, said plurality of engagable threads including a distal thread opposite said sleeve having a first thread height, a proximal thread proximate said sleeve having a second thread height, and a remainder plurality of engagable threads between said distal and proximal threads of varying thread height, wherein said first thread height is greater than said second thread height and said threads heights of said remainder plurality of engagable threads continuously taper between said first and second thread heights to provide a diminishing engagement surface from said distal thread to said proximal thread.

20. The component of claim 19, wherein said first end face of said sleeve is adapted to load against an annular axial surface of said shoulder.

* * * * *